US007418747B1

(12) United States Patent
Myers

(10) Patent No.: US 7,418,747 B1
(45) Date of Patent: Sep. 2, 2008

(54) FURNITURE

(76) Inventor: Jason D. Myers, 1717 Las Vegas Blvd. South, Las Vegas, NV (US) 89104

( * ) Notice: Subject to any disclaimer, the term of this patent is extended or adjusted under 35 U.S.C. 154(b) by 0 days.

(21) Appl. No.: 11/423,674

(22) Filed: Jun. 12, 2006

Related U.S. Application Data

(60) Provisional application No. 60/690,178, filed on Jun. 13, 2005.

(51) Int. Cl.
*A47B 81/00* (2006.01)
*A47C 19/22* (2006.01)

(52) U.S. Cl. ..... 5/308; 5/53.1; 5/58; 5/503.1; 312/327; 312/283

(58) Field of Classification Search ..... 5/308, 5/280, 53.1, 58, 633–635, 904, 905, 507, 5/503.1
See application file for complete search history.

(56) References Cited

U.S. PATENT DOCUMENTS

| | | | | | |
|---|---|---|---|---|---|
| 446,647 | A * | 2/1891 | Rankin | 312/295 |
| 1,954,632 | A * | 4/1934 | Lehman | 312/230 |
| 2,933,737 | A * | 4/1960 | Schiffmann | 5/308 |
| 2,937,383 | A * | 5/1960 | Rehfeld | 5/17 |
| 2,957,185 | A * | 10/1960 | Barrett | 5/59.1 |
| 3,358,957 | A * | 12/1967 | Lindenmuth | 248/279.1 |
| 3,419,921 | A * | 1/1969 | Flood | 5/308 |
| 3,636,548 | A * | 1/1972 | Meruzzelli | 312/282 |
| 3,889,914 | A * | 6/1975 | Torme | 248/445 |
| 4,016,610 | A * | 4/1977 | Ordonez | 5/2.1 |
| D267,839 | S * | 2/1983 | Lenger, Jr. | D6/506 |
| 4,780,919 | A * | 11/1988 | Harrison | 5/600 |
| 5,036,556 | A * | 8/1991 | Wieland | 5/53.1 |
| 7,181,784 | B1 * | 2/2007 | Geilear | 5/308 |

FOREIGN PATENT DOCUMENTS

| | | | |
|---|---|---|---|
| JP | 08224142 | A | 9/1996 |
| JP | 2002010174 | A | 1/2002 |
| JP | 2002095551 | A | 4/2002 |
| JP | 2002126015 | A | 5/2002 |
| KR | 200212411 | Y1 | 2/2001 |
| KR | 200258715 | Y1 | 12/2001 |
| KR | 200298845 | Y1 | 12/2002 |

* cited by examiner

*Primary Examiner*—Michael Trettel
(74) *Attorney, Agent, or Firm*—Rob L. Phillips; Greenberg Traurig

(57) ABSTRACT

A furniture member adapted to act as a versatile headboard is disclosed. The furniture member has a substantially vertical back member, two side members, a substantially vertical, lower front member and an angled front member collectively defining an interior space with the angled front member extending upward at a slope between the front lower member and a top edge of the vertical back member. The furniture member is placed against a mattress and box spring arrangement allowing people on the mattress to sit up by leaning against the angled front member. Adjustment of the angled front member is also disclosed. Use of the furniture member permits people to comfortably read, eat, use a laptop and conduct various other activities while in seated in bed. The furniture member also provides storage space.

18 Claims, 9 Drawing Sheets

FURNITURE

CROSS REFERENCE TO RELATED APPLICATIONS

This application claims the benefit of Provisional Application No. 60/690,178 filed Jun. 13, 2005.

FIELD OF THE INVENTION

The embodiments of the present invention relate to a furniture member for use with a bed. More particularly, the embodiments relate to a piece of furniture that acts as a backrest, headboard and storage unit.

BACKGROUND

Headboards come in many shapes, sizes and configurations. In most instances, headboards are decorative rather than functional; other than maintaining the stability of the corresponding bed. Also, headboards tend to interfere with one's ability to comfortably sit up in the bed. That is, headboards are fabricated of hard materials, like wood or iron, are positioned ninety degrees in relationship to the mattress, and/or incorporate shelving or ornate workmanship which collectively make headboards uncomfortable to sit up and rest or lean against.

Headboards also fail to provide, other than shelving, any significant storage space. Rather, many bedrooms utilize dressers and/or night stands to accommodate items which are occasionally useful in the bedroom but not desirous of display. Unfortunately, smaller bedrooms may become overcrowded with numerous pieces of furniture.

Thus, there is a need for a more versatile headboard overcoming the deficiencies associated with prior ubiquitous headboards.

SUMMARY

Accordingly, a first furniture member of the present invention comprises a substantially vertical back member, two side members, a substantially vertical, lower front member and an angled front member collectively defining an interior space, said angled front member extending upward at a slope between the front lower member and a top edge of the vertical back member.

In practice, the furniture member acts as a headboard and is positioned between a wall and a mattress and box spring arrangement. In such a configuration, the front angled member provides back support for a user sitting up in bed. The front angled member provides an ideal back support for users to read, write, eat, watch television or conduct countless other activities while seated in bed. In other embodiments, portions of the front angled member provides space for those items (e.g., lamps) typically placed on nightstands.

Another benefit of the furniture member of the present invention is the available concealed storage space. Drawers integrated in the lower section and the front angled member provide access to large amounts of storage space in a convenient location at a head of the bed.

Other variations, embodiments and features of the present invention will become evident from the following detailed description, drawings and claims.

DETAILED DESCRIPTION

Figure 1:
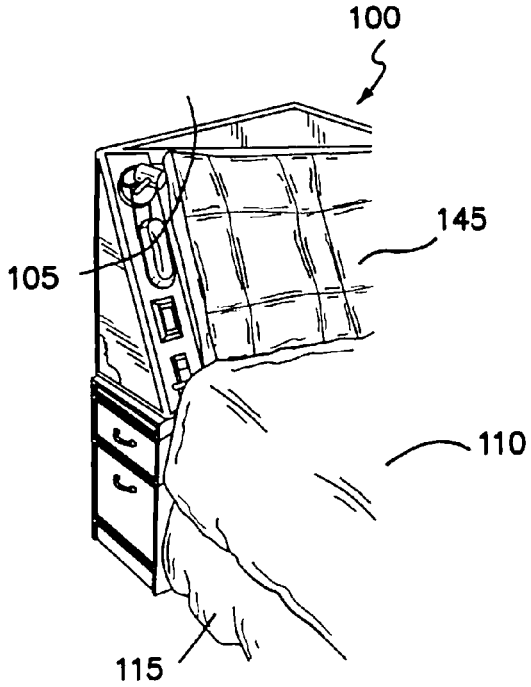
FIG. 1 illustrates a perspective front view of a first embodiment of the present invention with a mattress and box spring in place.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Reference is now made to the figures wherein like parts are referred to by like numerals throughout. FIG. 1 shows a perspective front view and side view, respectively, of a first embodiment of the present invention wherein the furniture member is generally referred to by reference numeral 100. As shown, the furniture member 100 is positioned between a wall 105 and a mattress 110 and box spring 115 arrangement. While a mattress 110 and box spring 115 arrangement is discussed throughout, any arrangement, including a mattress or a mattress stacked on another mattress, is conceivable. The furniture member 100 comprises a lower section 120 and an upper section 130. The lower section 120 is substantially rectangular in shape while the upper section 130 is substantially triangular in shape. The lower section 120 and upper section 130 may be a single unit or comprise two separate units. If formed of two separate units, the upper section 130 may simply rest on the lower section 120 or may be connected (e.g., bolted) thereto. In addition, for ease of moving, the furniture member 100 may comprise two sections separated vertically (i.e., two side-by-side sections). In such an embodiment, the two side-by-side sections are bolted together when positioned at the desired location. Wheels (not shown) may be placed on the lower section 120 to facilitate easy movement of the furniture member 100.

Figure 3:
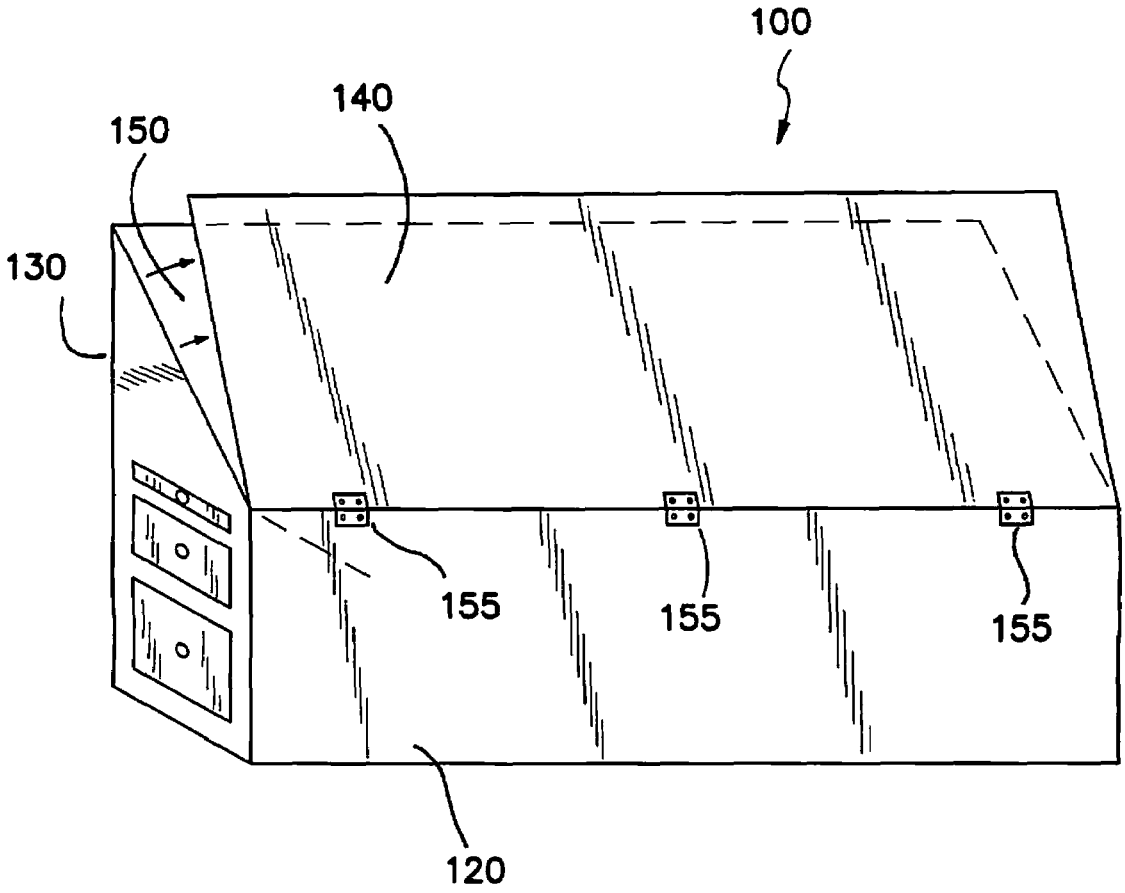
FIG. 3 illustrates a front perspective view of the present invention with a front angled member attached using a first means.
Figure 4:
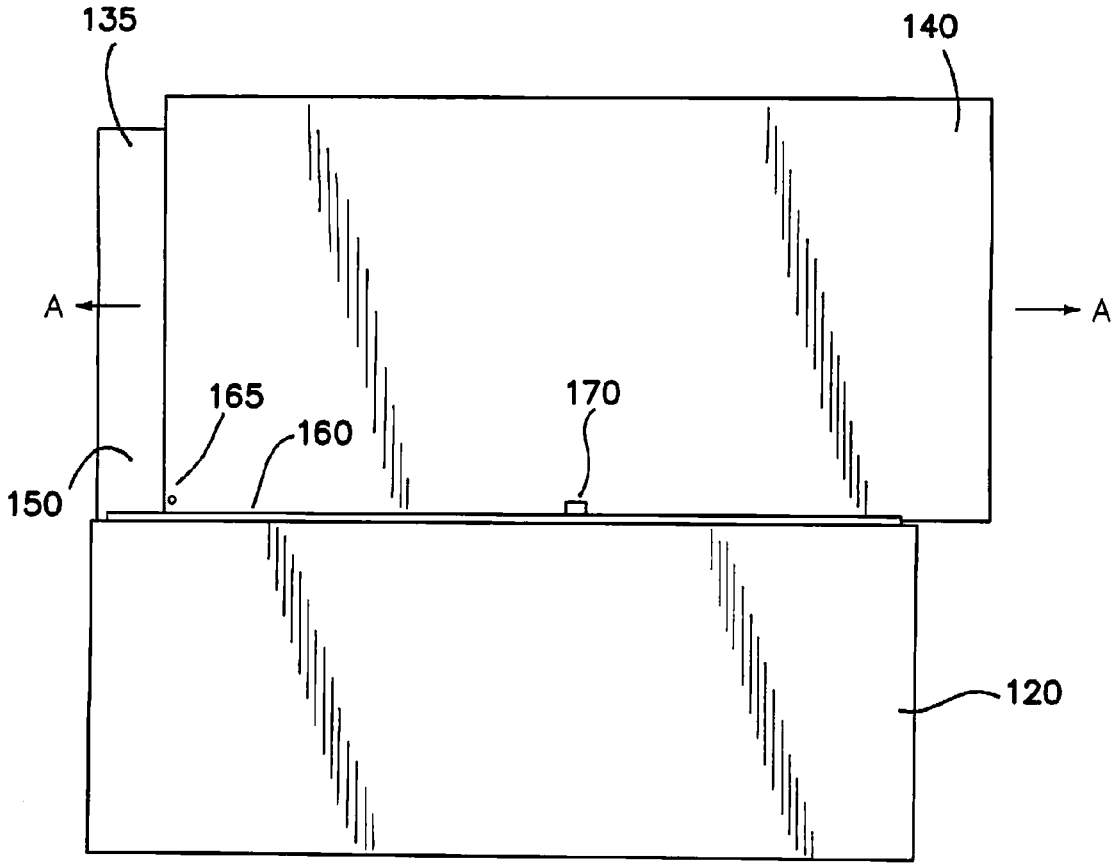
FIG. 4 illustrates a front perspective view of the present invention with the front angled member attached using a second means.

The upper section 130 includes a generally vertical rear member 135 and a front member 140 forming an acute angle (<A) therebetween. In such a configuration, the angled front member 140 slopes away from a head of the mattress 110 allowing a user to sit upright comfortably on the mattress 110. Ideally, pads 145 provide a cushioned section for the user to rest or lean against. As seen in FIG. 3, the angled front member 140 can be opened to access a first storage area 150 optionally separated by a horizontal member from a storage area defined by the lower section 120. In FIG. 3, hinges 155 join the angled front member 140 at its lower edges to the lower section 120. It will understood by those skilled in the art that the angled front member 140 may be moveably connected to the lower section 120 by any suitable means, including by means of a slider arrangement as shown in FIG. 4. The slider 160 permits the angled front member 140 to be moved along its bottom edge in directions represented by arrows A. Ideally a stop 170 prevents the angled front member 140 from being moved to far in either direction. A locking mechanism 165 prevents the angled front member 140 from sliding unintentionally. It will also be understood by those skilled in the art that the angled front member 140 may be moveably integrated into the furniture member 100 along any of its edges and not only the bottom edge. In such alternative configurations, the angled front member 140 may open upwards or to the sides instead of downward in the case of the hinges 155 at its lower edge. Therefore, the angled front member 140 or sections thereof, may be connected to the upper section 130 or the lower section 120.

Figure 9:
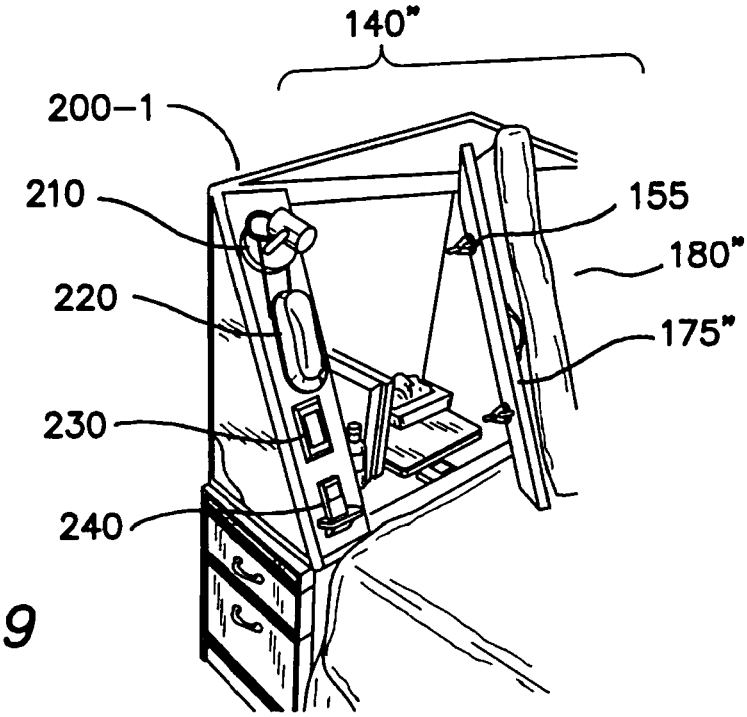
FIG. 9 illustrates a perspective front view of a second alternative embodiment of the front angled member.
Figure 8:
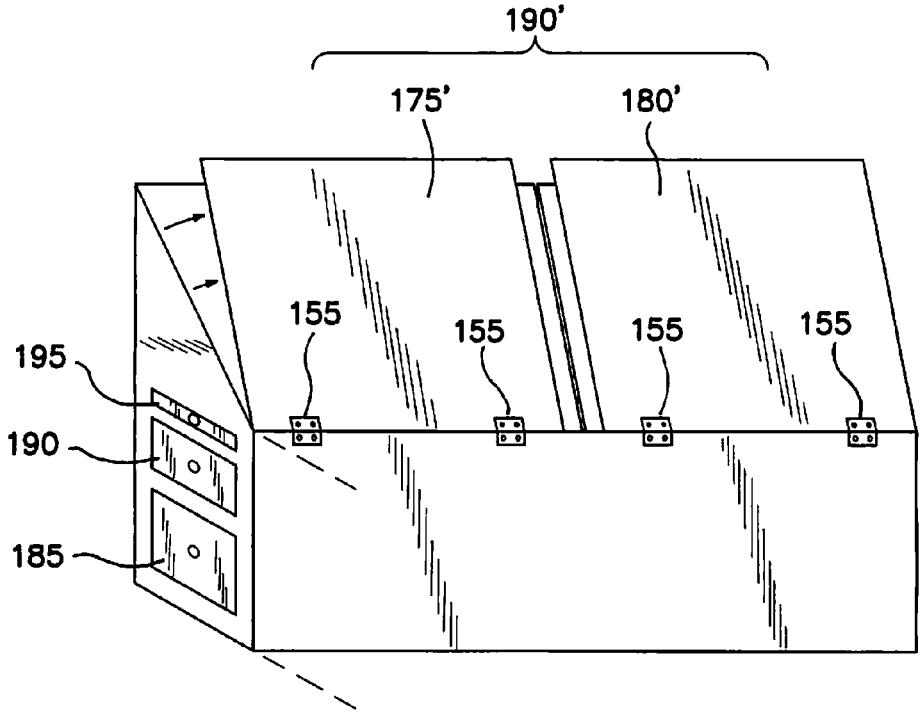
FIG. 8 illustrates a perspective front view of a first alternative of the front angled member.

Moreover, FIGS. 8 and 9 each show alternative angled front members 140', 140" configurations each comprising two separate sections or doors 175', 175", 180' and 180" which open, by means of hinges 155, in different directions. With respect to the angled front member 140, any number of separate sections and configurations are possible without departing from the spirit and scope of the present invention.

Figure 5:
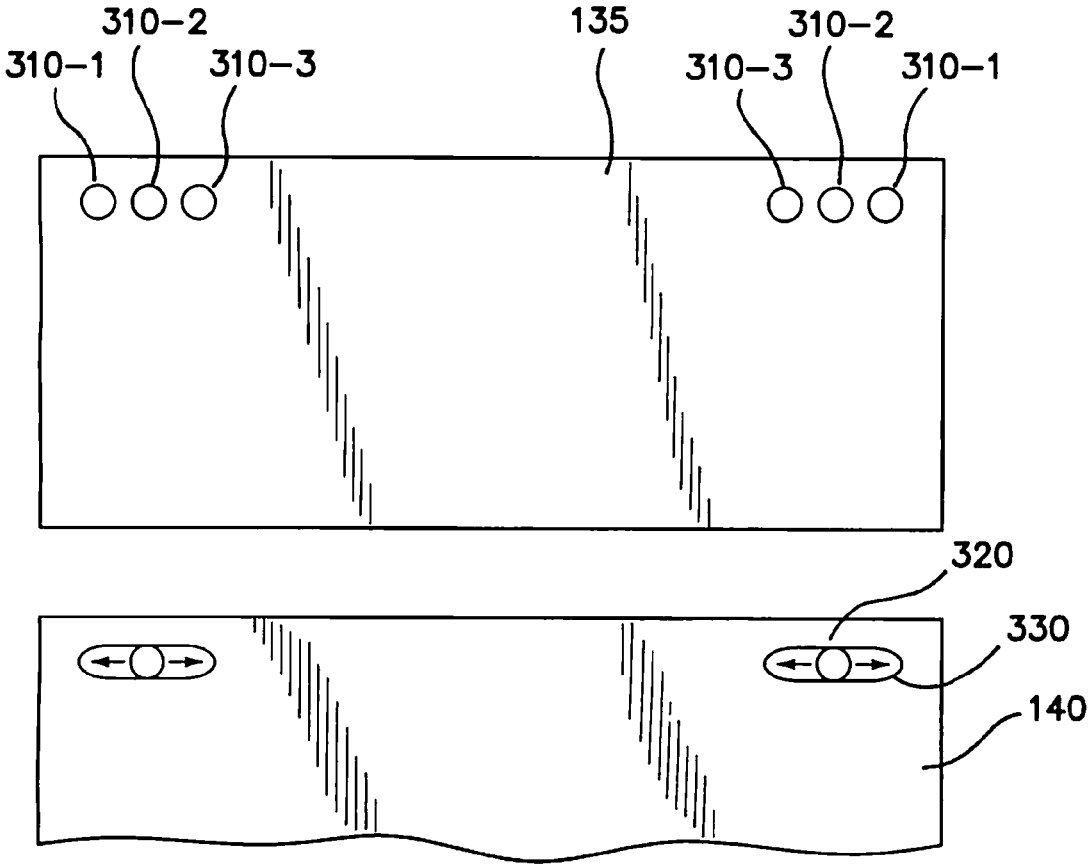
FIG. 5 illustrates a means for adjusting the front angled member.

Regardless of the configuration of the angled front member 140, in some embodiments, the angled front member 140 or separate sections thereof are adjustable such that the slope of the angled front member 140 or the separate sections can be adjusted. FIG. 5 shows one exemplary means for adjusting the slope of the angled front member 140 with reference to interior portions of the rear member 135 and the angled front member 140. The means comprises a series of cavities 310-1 through 310-3, having varied depths, positioned along a top, interior edge of the rear member 135 and a pair of slidable, spaced pins 320 positioned along a top, interior edge of the front angled front member 140. The pins 320 may be adjusted laterally along a groove 330 to multiple positions corresponding to the positions of the cavities 310. To adjust the angle, one selects the desired corresponding cavities 310-1 through 310-3, positions the pins 320 laterally (as represented by the arrows) and places the pins 320 into the corresponding cavities 310-1 through 310-3 thereby modifying the angle at which the angled front member 140 rests. The varying depths of the cavities 310-1 through 310-3 dictate at what angle the front angled front member 140 rests. More or less than the three cavities 310-1 through 310-3 may be integrated into the rear member 135. It will be understood by those skilled in the art that any suitable adjustable means may be employed without departing from the spirit and scope of the present invention.

Figure 6:
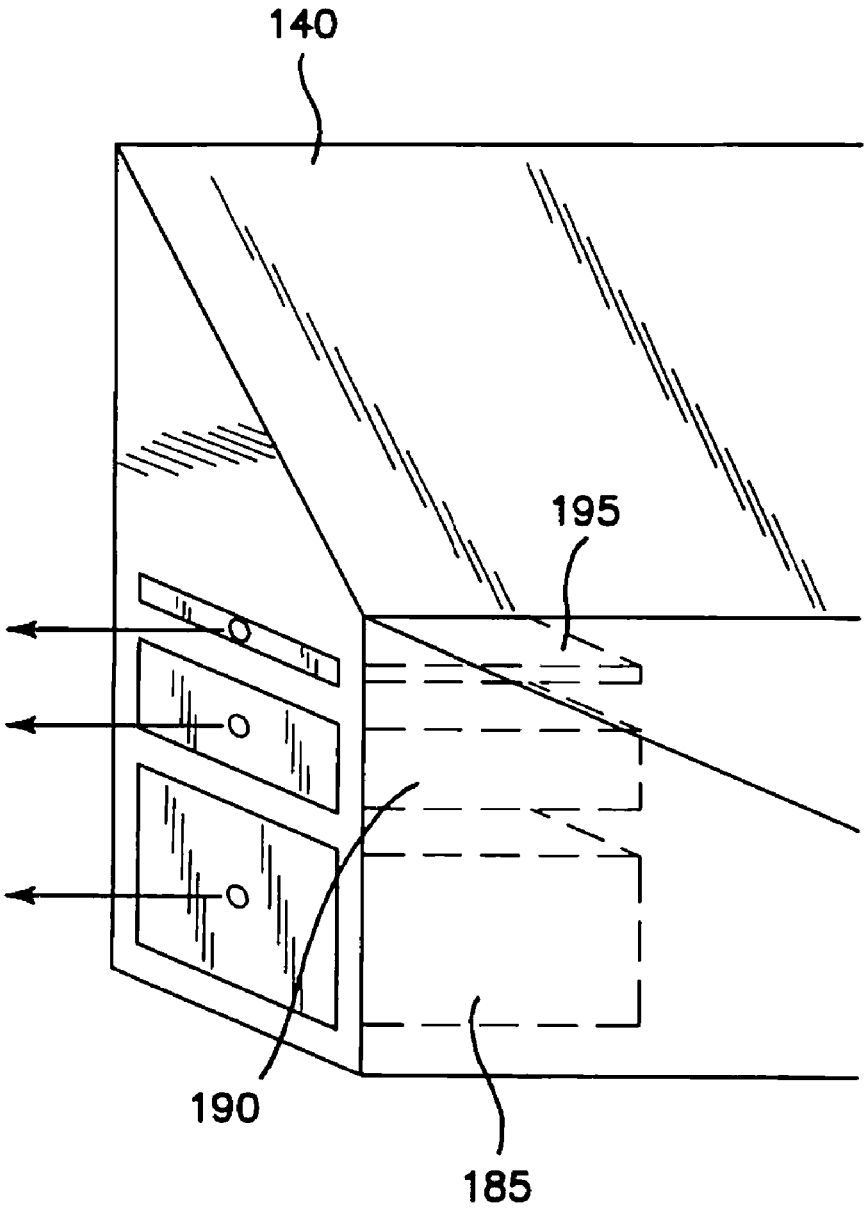
FIG. 6 illustrates a front perspective transparent view of the first embodiment of the present invention.

FIG. 6 shows a transparent view of the furniture member 100. The lower section 120 provides significant storage space via multiple drawers 185, 190. Similar drawers may be integrated at both, opposite ends of the lower section 120. That is, those ends that face outward from the furniture member 100. A pull out table 195 is also positioned at both ends such that users may place items (e.g., laptop, papers, etc.) temporarily thereon as needed. The number and size of drawers and tables integrated into the lower section 120 can take on countless configurations without departing from the spirit and scope of the present invention. Depending on the length of the drawers 185, 190, there may be space available therebetween for certain items such as a subwoofer that works in conjunction with speakers mounted to outer portions of the angled front member 140 as described in more detail below. It is also conceivable that a large cupboard, cutout or similar concealed opening may be integrated into the lower section in place of, or in combination with, the drawers. For example, a large concealed opening may permit a computer tower to be positioned within the confines of the lower section 120.

Figure 7:
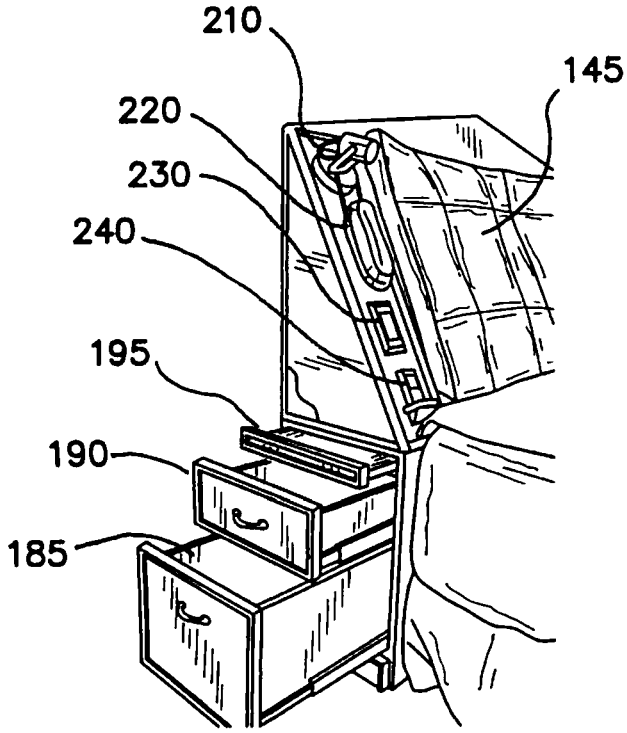
FIG. 7 illustrates a front view of a portion of the front angled member supporting certain bedtime items.
Figure 10:
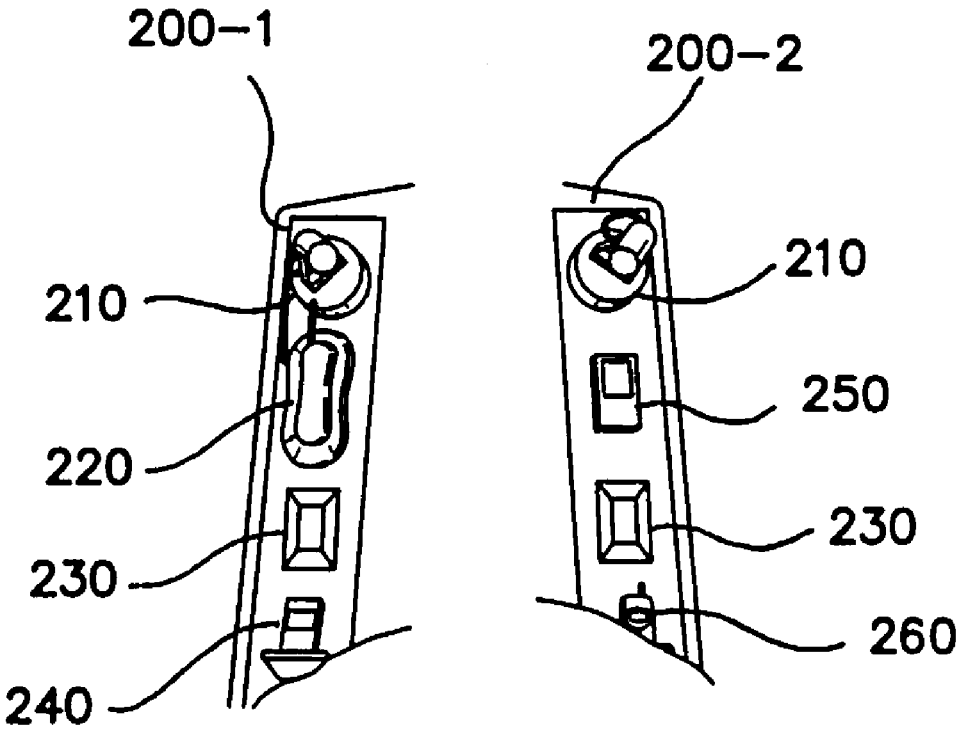
FIG. 10 illustrates outer portions of the present invention.
Figure 11:
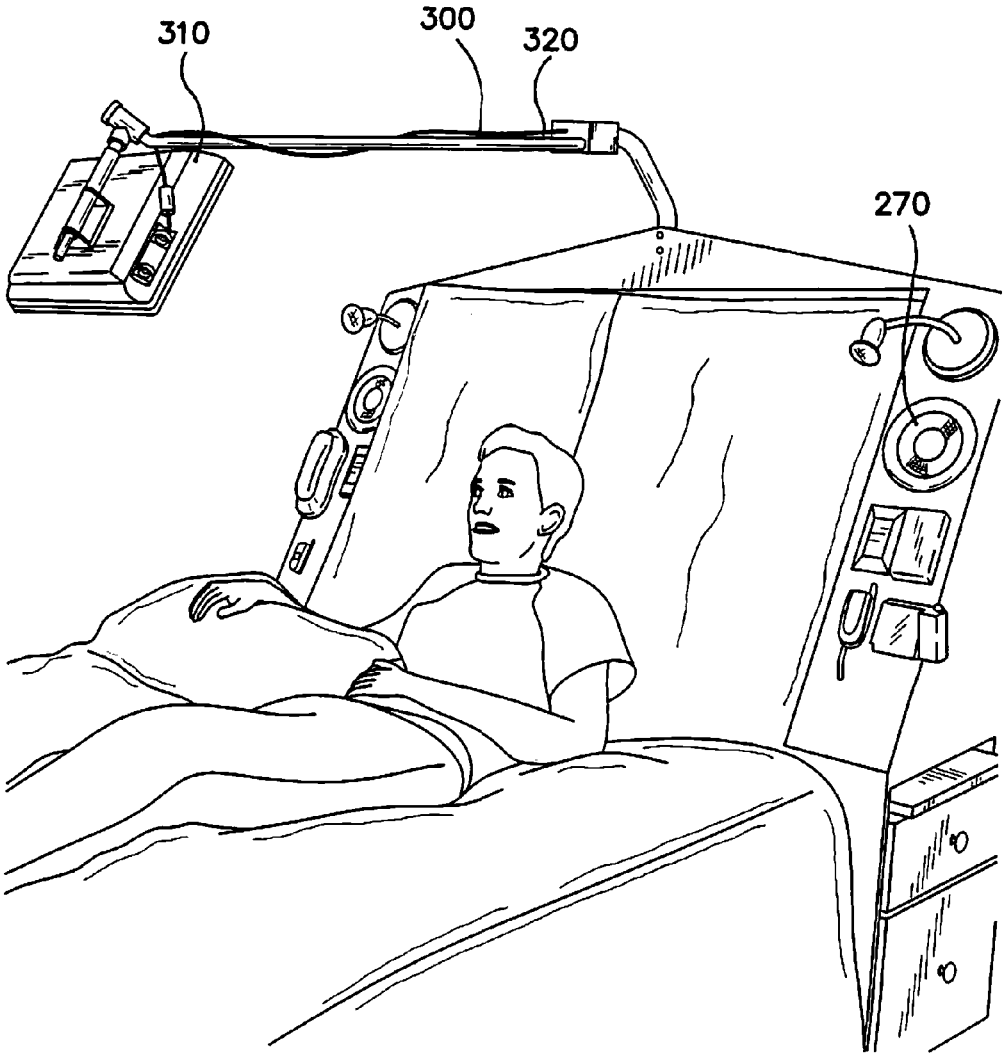
FIG. 11 illustrates a system for attaching television to an embodiment of the present invention.

Now referring to FIGS. 7, 9 and 10, in one embodiment, outer portions 200-1 and 200-2 of the angled front member 140 are not padded and provide space for attaching or placing desired nighttime items such as phones, lights, MP3 players, drinking glasses, clocks, speakers, etc. The outer portions 200-1 and 200-2 may be pre-configured to receive specific items or may be configured to receive numerous items having a range of configurations and dimensions. As shown, from top to bottom, a first outer portion 200-1 supports a lighting unit 210, cordless telephone 220, light control 230 and an MP3 player 240 and a second outer portion 200-2 supports a lighting unit 210, remote control device 250, light control 230 and cellular telephone 260. FIG. 11 shows speakers 270 integrated to the outer portions 200-1 and 200-2 of the angled front member 140. The supported items listed herein are exemplary and not intended to be exhaustive. The outer portions 200-1 and 200-2 may also include shelves or slots for the placement of desired items.

Figure 2:
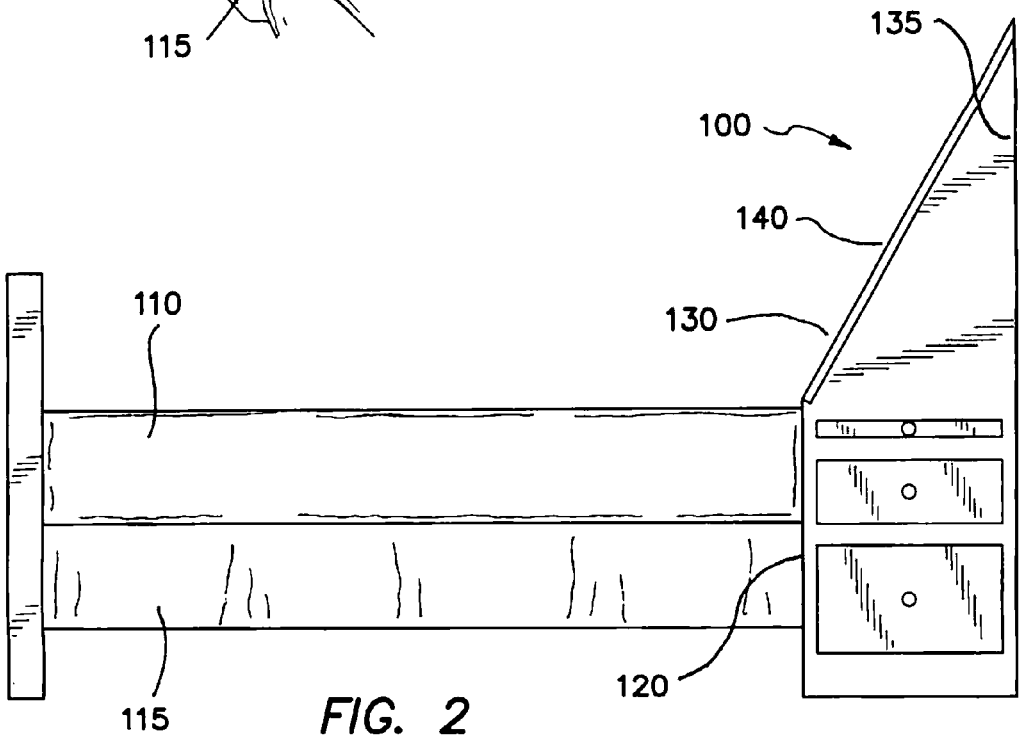
FIG. 2 illustrates a side view of the first embodiment of the present invention with a mattress and box spring in place.

In practice, the furniture member 100 is positioned, as shown in FIGS. 1 and 2, between the wall 105 and mattress 110 and box spring 115 arrangement. Therefore, the wall 105, along with the furniture member 100, provides the necessary support for one or more people to simultaneously lean against the angled front member 140. It is also conceivable that the furniture member 100 itself can support multiple people without being positioned against the wall 105. Also, the mattress 110 and box spring 115 may be pushed up against the furniture member 100 in an unconnected manner or may be securely attached to the furniture member 100 by means of conventional bed railings (not shown) and screws or bolts. If utilized, the bed railings extend between, and are connected to, the furniture member 100 and a foot member 175 as shown in FIG. 2. In position, the bed railings support the box spring 115 and elevate the mattress 110 and box spring 115 arrangement.

FIG. 11 shows a system for attaching a television to the upper section 130 of the furniture member 100. The system comprises an elongated rod 300 attached at a first end to a rear surface of the upper section 130 and a second end to a rear surface of a flat panel television 310. The elongated rod 300 may be a single unit or comprise multiple sections. In a wired system, wires 320 (e.g., power cord) can be run along the rod 300 or within the rod 300 to conceal the same and extended to a power outlet behind the furniture member 100. Ideally, the rod 300 is rotatably attached to the rear surface of the upper section 130 so that the rod 300 and television 310 may be moved out of the way when not in use. Alternatively, the rod 300 may be formed of telescoping members allowing it to be shortened for better viewing or storage. Also, the television 310 may be rotatably attached to the rod 300 so that a screen of the television 310 may be positioned or angled as desired.

In a similar manner, a food tray (not shown) may be rotatably attached to the upper section 130 such that the food tray may allow users to eat conveniently while in the bed. Such an embodiment is especially useful and beneficial for the elderly or others confined to bed. With bed configurations as shown in FIGS. 8 and 9, the food tray and a corresponding support rod, when not in use, may be placed in a vertical opening between the two sections or doors 175', 175", 180' and 180". In this manner, the food tray and rod are concealed and out of the way when not in use. When needed, the rod and food tray extend from the space and the food tray is swiveled to provide a generally horizontal surface for food and drinks.

Although the invention has been described in detail with reference to several embodiments, additional variations and modifications exist within the scope and spirit of the invention as described and defined in the following claims.

I claim:

1. A furniture member comprising:

a substantially vertical back member, two side members, a substantially vertical, lower front member and an angled front member collectively defining an interior space, said angled front member extending upward at a slope between the front lower member and a top edge of the vertical back member; and wherein the angled front member is slidably connected to the lower front member such that it may be repositioned to access the interior space.

2. The furniture member of claim 1 wherein the two side members provide access to one or more drawers and/or pull out tables.

3. The furniture member of claim 1 wherein the angled front member comprises two separate sections.

4. The furniture member of claim 1 wherein a height of the lower front member is based on a height of a mattress and box spring arrangement.

5. The furniture member of claim 1 wherein said angled front member may be repositioned to adjust its slope.

6. The furniture member of claim 1 further comprising a system for positioning a television and/or a food tray.

7. A furniture member comprising:

a substantially rectangular lower section defining a first storage space;

an upper section, said upper section having an angled front member, two side sections and a substantially vertical rear section defining a second storage space wherein said second storage space is accessible by repositioning at least a section of the front angled member; and wherein at least a section of the angled front member is slidably connected to the lower section.

8. The furniture member of claim 7 wherein the lower section and the upper section are one piece.

9. The furniture member of claim 7 wherein the lower section and the upper section are separate pieces.

10. The furniture member of claim 7 wherein at least a section of the angled front member may be repositioned to adjust its slope.

11. The furniture member of claim 7 wherein the angled front member may be repositioned to adjust its slope.

12. The furniture member of claim 7 wherein outer portions of the angled front member are adapted to support items selected from the group consisting of lights, telephones, MP3 players, remote controls, light controls, drinking glasses and clocks.

13. The furniture member of claim 7 wherein a portion of the angled front member is padded.

14. The furniture member of claim 7 wherein the angled front member comprises two separate sections.

15. The furniture member of claim 7 further comprising a system for positioning a television and/or food tray.

16. A furniture member adapted to act as a headboard comprising:

a substantially vertical back member, two side members, a substantially vertical, lower front member and an angled front member collectively defining an interior space, said angled front member extending upward at a slope between the front lower member and a top edge of the vertical back member and repositionable to access the interior space, said angled front member adjustable to change its slope and said lower front member having a height commensurate with a mattress and box spring arrangement; and wherein the angled front member is slidably connected to the lower front member such that it may be repositioned to access the interior space.

17. The furniture member of claim 16 further comprising a system for positioning a television and/or food tray.

18. The furniture member of claim 16 further comprising a system for positioning a television and/or food tray.

* * * * *